US008678815B2

(12) United States Patent
Frost

(10) Patent No.: US 8,678,815 B2
(45) Date of Patent: Mar. 25, 2014

(54) CHAMBER FURNACE WITH OVERTEMPERATURE

(75) Inventor: Georg Frost, Steinheim (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 610 days.

(21) Appl. No.: 12/912,148

(22) Filed: Oct. 26, 2010

(65) Prior Publication Data

US 2011/0269086 A1 Nov. 3, 2011

(30) Foreign Application Priority Data

Oct. 29, 2009 (DE) ..... 10 2009 051 157

(51) Int. Cl.
*F27D 13/00* (2006.01)

(52) U.S. Cl.
USPC ..... 432/4; 432/12; 432/247

(58) Field of Classification Search
USPC ..... 432/1, 4, 12, 120, 178, 159, 247
See application file for complete search history.

(56) References Cited

U.S. PATENT DOCUMENTS

| | | | | |
|---|---|---|---|---|
| 3,624,806 | A * | 11/1971 | Lytzen | 432/11 |
| 4,026,679 | A * | 5/1977 | Collin | 48/73 |
| 6,046,439 | A * | 4/2000 | Johnsgard et al. | 219/444.1 |
| 7,410,355 | B2 * | 8/2008 | Granneman et al. | 432/5 |
| 2001/0023055 | A1 * | 9/2001 | Sakamoto et al. | 432/18 |
| 2009/0127753 | A1 | 5/2009 | Vehof et al. | |
| 2009/0226855 | A1 * | 9/2009 | Rohner et al. | 432/4 |

FOREIGN PATENT DOCUMENTS

| | | |
|---|---|---|
| DE | 34 38 920 A1 | 4/1986 |
| DE | 10 2005 057 742 | 6/2007 |

* cited by examiner

*Primary Examiner* — Gregory A Wilson
(74) *Attorney, Agent, or Firm* — Henry M. Feiereisen LLC

(57) ABSTRACT

In a method of heating a structure, an interior space of a furnace is heated to an interior temperature which is greater than a desired temperature to which a structure is intended to be heated. The structure is then placed into the furnace while the interior space is at least at the interior temperature at all times. When the structure has been heated to the desired temperature, it can be removed from the furnace at the desired temperature which is lower than the interior furnace temperature.

9 Claims, 4 Drawing Sheets

CHAMBER FURNACE WITH OVERTEMPERATURE

CROSS-REFERENCES TO RELATED APPLICATIONS

This application claims the priority of German Patent Application, Serial No. 10 2009 051 157.1-24, filed Oct. 29, 2009, pursuant to 35 U.S.C. 119(a)-(d), the content of which is incorporated herein by reference in its entirety as if fully set forth herein.

BACKGROUND OF THE INVENTION

The present invention relates to a method of heating a structure, e.g. to undergo a subsequent hot forming process, and to an apparatus for carrying out the method.

The following discussion of related art is provided to assist the reader in understanding the advantages of the invention, and is not to be construed as an admission that this related art is prior art to this invention.

The mechanical resistibility of steel structures can be enhanced by hardening the material through heating and subsequent rapid quenching. The change in position of the carbon atoms in the metal lattice is the reason for the increase in hardness and begins when the austenitic temperature has been reached. The following quenching leads to a martensitic microstructure that significantly increases the strength of the structure. In the case of thin-walled steel structures, for example steel sheet blanks, the application of compression molding or press hardening has been shown reliable to hot-form metal sheets. After being heated, the blank is placed in a shaping tool to undergo a subsequent forming and hardening through quenching. In particular the automobile industry increasingly demands for ecological and economical reasons that the thus manufactured high-strength body structures exhibit a beneficial ratio of strength to weight.

The use of elongated or round continuous furnaces, such as for example rotary hearth furnaces or roller hearth furnaces, placed upstream of the shaping and hardening processes has been proposed to continuously supply the press tools with heated steel sheets. A steel sheet placed in the continuous furnace is moved through the furnace by a transport device and heated thereby under the furnace atmosphere and maintained at this temperature. The structure reaches its desired temperature for austenitization prior to its removal via the furnace exit.

Continuous furnaces are in general bulky and require much space. The transport systems typically used in such furnaces are subject to increased wear regardless of their position because they operate in a continuous mode and are continuously exposed, at least in part, to the hot furnace atmosphere. Due to its dimensions, the overall facility is considered static and inflexible and complicated so as to render the facility difficult to modify and reposition. As a result, the facility is not only cost-intensive but has a large footprint and is difficult to integrate in existing constructions. Maintenance works require a cool down of a relatively bulky heated mass which subsequently has to be completely heated again. The result is excessive energy consumption. Also the passage time of the structures to be heated inside the furnace atmosphere is long so that the structures show a tendency for scale formation and surface decarburization.

It would therefore be desirable and advantageous to address prior art shortcomings.

SUMMARY OF THE INVENTION

According to one aspect of the present invention, a method of heating a structure includes the steps of heating an interior space of a furnace to an interior temperature which is greater than a desired temperature to which a structure is intended to be heated, placing the structure into the furnace while the interior space is at least at the interior temperature at all times, and removing the structure from the furnace when the structure has been heated to the desired temperature.

The present invention resolves prior art problems by heating the structure in the furnace to a desired temperature that has been predefined beforehand. Once the structure has been heated and removed, the structure can be transferred to undergo a further processing step, e.g. hot forming. Of course, the heating process may also result in a conclusion of a surface treatment or serve to temper steel structures to decrease internal stress. The interior temperature of the furnace should be above the predefined desired temperature at all times. As soon as the desired temperature has been reached, the structure can be removed from the furnace. In other words, there is no need to heat the structure to the interior temperature. As a result, the heating-up rate is increased and the heating-up time is shortened for the structure.

As a consequence of the difference between the interior furnace temperature and the temperature of the structure in the furnace, heat flows normally into the structure until the temperatures have equalized. The heating-up rate of the structure progressively decreases as the structure temperature approaches the interior temperature of the furnace. This explains also the required long retention times of structures in continuous furnaces in which the interior temperature is significantly lower and corresponds to the desired temperature of the structures placed in the furnace. In the presence of an overtemperature in the furnace in accordance with the present invention, the heating-up rate in relation to the desired temperature slows down later so that the structure reaches its desired temperature faster and can be removed from the furnace after a significantly shorter heating-up time.

According to another advantageous feature of the present invention, the preset interior temperature of the furnace may be at least 15% above the desired temperature of the structure. This ratio establishes an efficient balance between introduced energy consumption for the overtemperature of the furnace and the attained shortened heating-up rate of the structure. As the retention time in the furnace atmosphere is considerably shorter, the cycle time is decreased and the possibility of scale formation and surface decarburization is significantly reduced.

According to another advantageous feature of the present invention, the interior temperature may be 1100° C. to 1200° C. and the desired temperature for the structure may be 850° C. to 950° C. for the austenitization.

According to another advantageous feature of the present invention, the furnace may be constructed in the form of a chamber furnace having a furnace chamber constructed to individually heat each structure. As a result, the required overtemperature inside the furnace can be realized with little energy consumption. As the chamber furnace has a compact configuration, the ratio of furnace surface and furnace volume in relation to the structure being heated is very beneficial. Despite the presence of an overtemperature, the required energy input is much smaller compared to continuous furnaces. Of course, the chamber furnace may include several furnace chambers and/or several chamber furnaces may be operated in parallel.

According to another advantageous feature of the present invention, a protective gas atmosphere may be established in the furnace chamber. This further contributes to substantially prevent decarburization or scaling of the structure during the heating process. As the furnace volume in a chamber furnace is smaller than in a continuous furnace, the amount of protective gas needed is accordingly smaller so that the chamber furnace can be operated much more economically.

According to another advantageous feature of the present invention, the structure can be fixed in place while being heated in the interior space in order to eliminate the need for transport elements in the interior space of the furnace. As the structure is accurately positioned during or in particular after undergoing the heating process, the need to reposition the structure is also eliminated. In particular, when contemplating automated loading and unloading of the furnace, the fixed placement of the structure inside the furnace simplifies control and results in time savings. As there are no parts of a transport device in permanent contact with the furnace atmosphere, the heating process is focused only on the structure in the furnace. There is no unnecessary heating of movable elements and no concern of increased wear due to heat exposure.

According to another advantageous feature of the present invention, the temperature of the structure may be ascertained while being heated in the interior space, and the furnace is opened, when the structure has reached the desired temperature. The structure can then be removed from the furnace at the desired temperature which is less than the interior temperature. As a result, the heating process can be reliably reproduced to provide same structure properties for the later shaping and/or treatment process.

As an alternative or in addition to the temperature determination, there may also be the option to open the furnace in a time-controlled manner, i.e. after a fixed predefined time interval, and then to remove the structure from the furnace chamber.

In principle, all possible structure configurations and materials, like for example pre-shaped cross sections of plastic, can be heated in this manner. It may be beneficial however when the structure has a thin-walled cross section, e.g. involves a steel sheet. Suitably, the steel sheet is heated in the furnace atmosphere to a hardening temperature of >Ac3 and austenitized to further enhance strength properties.

According to another aspect of the present invention, an apparatus for heating a structure includes a furnace having an interior space for placement of a structure to be heated, with the interior space being heatable to an interior temperature which is greater than a desired temperature to which the structure is to be heated, wherein the interior space is bounded by inside walls, with the structure being placed into the interior space at a maximum distance of 30 centimeters to the inside walls.

An apparatus according to the present invention strikes an economical balance between an interior space of the further chamber to be heated and the structure positioned in the furnace chamber and undergoing a heating process. As a result, there is no unnecessary heating of interior space that is not occupied by the structure while still providing enough distance to permit easy maneuvering during loading and unloading of the furnace chamber.

A method and apparatus for carrying out the method for heating a structure has many advantages when compared with a continuous furnace. Besides the significant reduction in the footprint of the apparatus according to the invention, the heating-up time is decreased by about 80% depending on the respective furnace temperature. As the structure is heated more rapidly so that the retention time in the furnace atmosphere is significantly shortened, scale formation and decarburization is greatly minimized. The shorter heating-up time reduces the necessary cycle time per structure and thus increases the possible cycle sequence. The use of smaller chamber furnaces that can be handled much easier enhances flexibility to permit a rapid modification of the apparatus.

The elimination of transport elements in the furnace chamber also minimizes maintenance works. No elements are unnecessarily being heated. Energy consumption is significantly reduced by the shorter heating-up time and by the smaller dimension of the interior volume of the furnace chamber as only few elements are inside. As the structure can be removed at any time upon reaching the desired temperature, there is no unnecessary retention in the furnace atmosphere.

In combination with a temperature determination member, e.g. temperature sensor, the method according to the present invention can be best suited to situations at hand depending on the desired structure temperature without requiring to wait for the conclusion of a previously established transport process. Even structures of different starting temperature can now easily be integrated into the manufacturing process.

In summary, cycle time is reduced and thermal stress of the structure and accompanying scale formation with subsequent refinishing operation are kept to a minimum.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
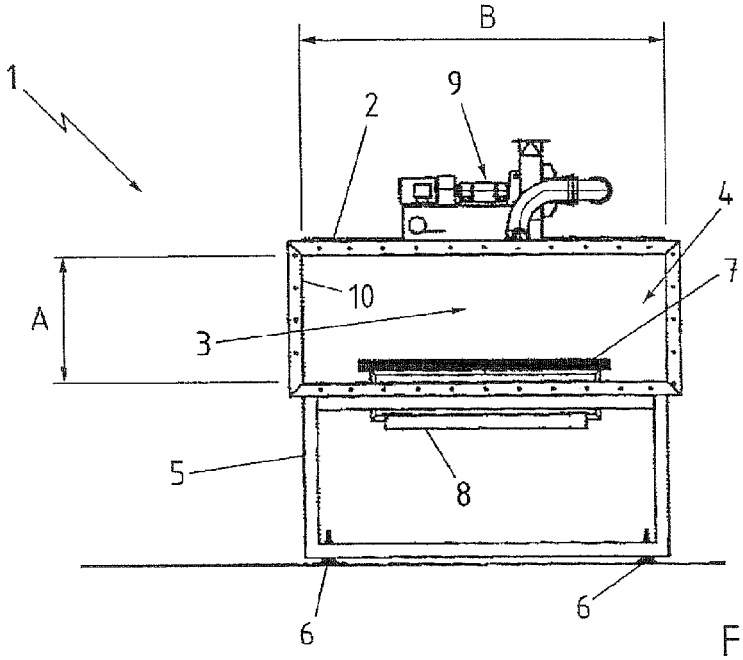
FIG. 1 is a schematic illustration of an apparatus in accordance with the present invention in the form of a chamber furnace.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic illustration of an apparatus in accordance with the present invention, including a furnace generally designated by reference numeral 1 and constructed in the form of a chamber furnace. The furnace 1 includes essentially a box-shaped housing 2 closed on five sides and having an access opening 3 on a length side to serve as loading site to a furnace chamber 4. The access opening 3 may be closed by a lid, shown schematically by way of example in FIG. 5 and labeled with reference numeral 14, so that the furnace chamber 4 is closed all-round.

The housing 2 of the furnace 1 is placed across a stand 5 comprised of hollow sections, and is firmly connected thereto. Both the furnace 1 and the stand 5 have a rectangular base area, with the stand 5 having an adjustable foot in each of the corners via which the furnace 1 can be placed on the ground and precisely positioned by adjusting each individual foot 6. The furnace chamber 4 has an interior space in which a placement area 7 is provided in a bottom side of the furnace chamber 4. A burner 8 is arranged to the outside of the bottom side of the housing 2 in the area of the stand 5. Arranged on the outer side of the housing 2 in opposition to the burner 8 is a recuperator 9 which thus sits on the furnace 1 and is connected through the housing 2 and an inside surface 10 of the furnace chamber 4 with the furnace chamber 4. The access opening 3 and the furnace chamber 4 are defined by a height A and in transverse direction by a width B.

Figure 2:
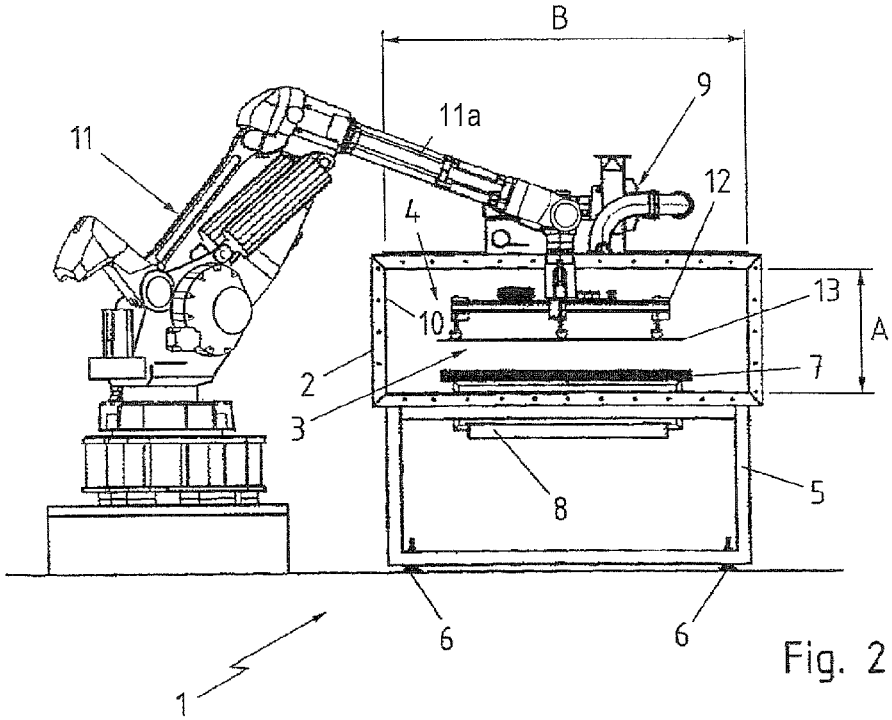
FIG. 2 is a schematic illustration of the apparatus of FIG. 1 in combination with a robot placed next thereto.

FIG. 2 shows a schematic illustration of the furnace 1 in combination with a robot, generally designated by reference numeral 11 and placed next to the furnace 1. The robot 11 stands to the side of the access opening 3 of the furnace 1. The robot 11 has a robot arm 11*a* and a coupling unit 12 disposed at an end of the robot arm 11*a* for capturing and depositing a structure 13.

Figure 3:
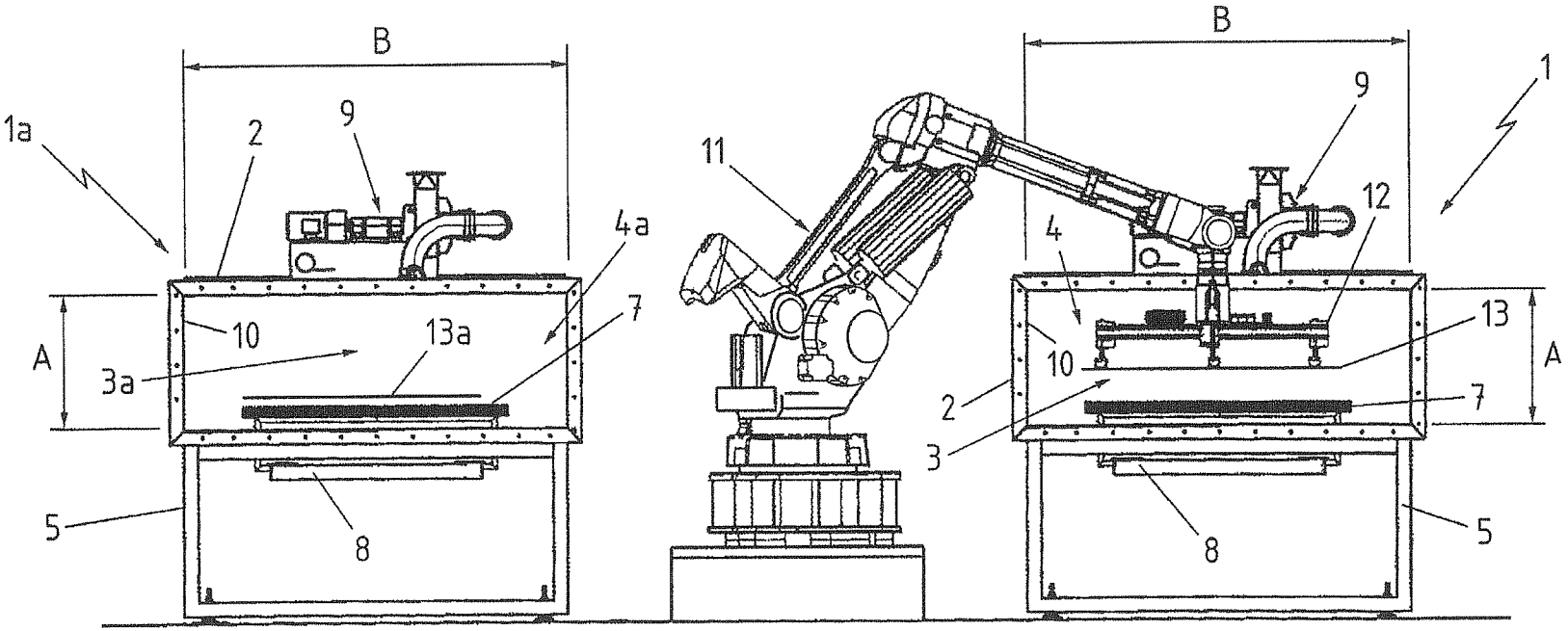
FIG. 3 is a schematic illustration of the apparatus in combination with the robot in combination with a further chamber furnace as shown in FIG. 1.

FIG. 3 shows a schematic illustration of the furnace 1 in combination with the robot 11 and an additional furnace 1*a*. This arrangement corresponds to a possible use in practice, with the robot 11 being placed between the furnace 1 and the furnace 1*a*.

Figure 4:
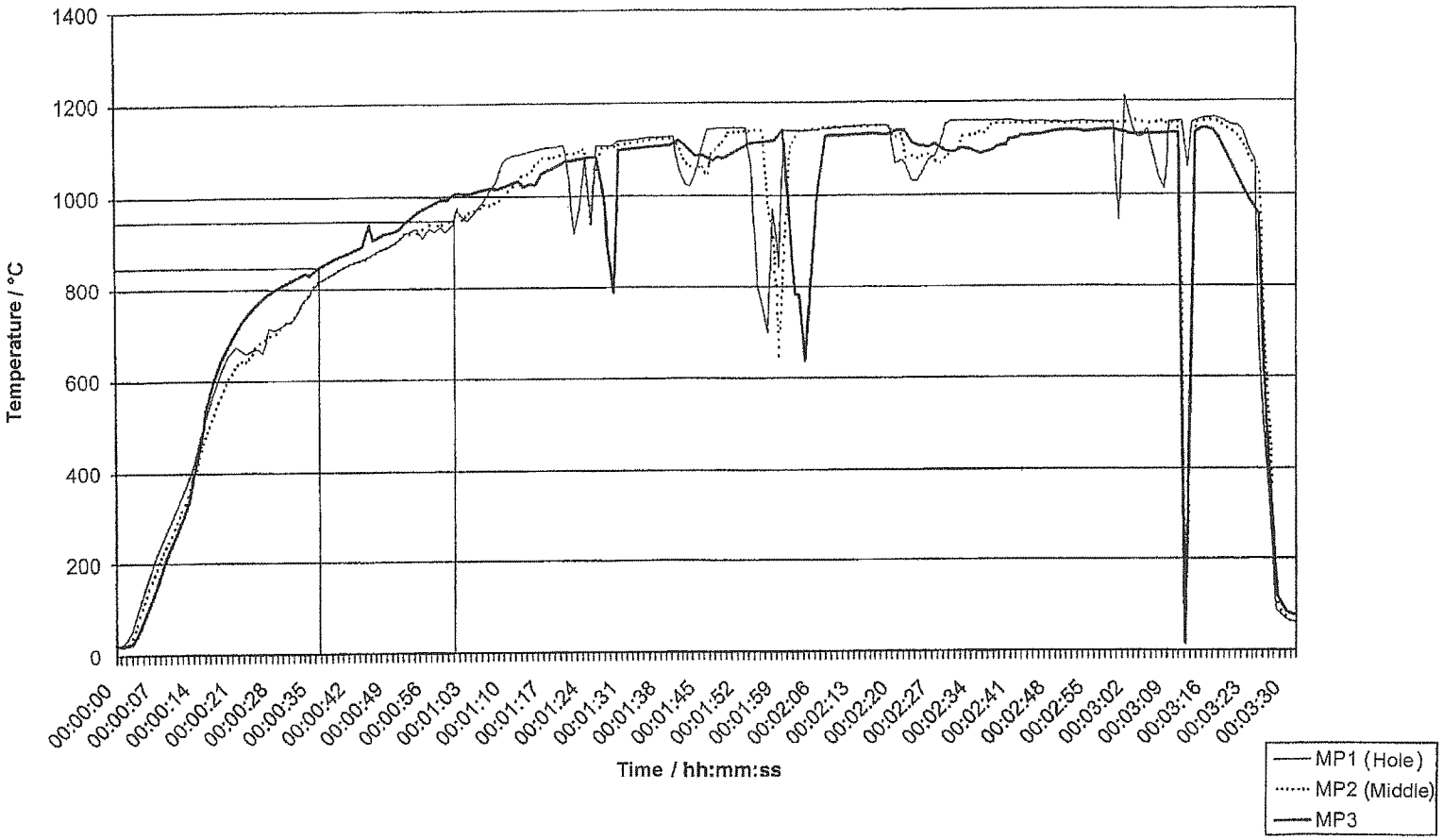
FIG. 4 is a graphical illustration of a temperature profile of a structure in relation to the elapsed time as the structure is heated in a continuous furnace that has been heated to an overtemperature.

In the run-up to a hot forming process, the structure 13 in the form of a steel sheet is placed on the placement area 7 inside the furnace chamber 4 at a distance of about 30 centimeters to each inside wall surface 10 of the furnace chamber 4. The temperature of the structure 13 at this point corresponds to the outer ambient temperature of 25° C. The burner 8 heats the interior space of the furnace chamber 4 to an interior temperature of about 1150° C., with the recuperator 9 being used to pre-heat a protective gas atmosphere within the furnace chamber 4. The substantial temperature differential between the interior temperature of the furnace chamber 4 and the structure 13 results in a high and initially nearly linear heating-up rate of about 24° C. per second, as can be seen in FIG. 4 which will be described further below.

Figure 5:
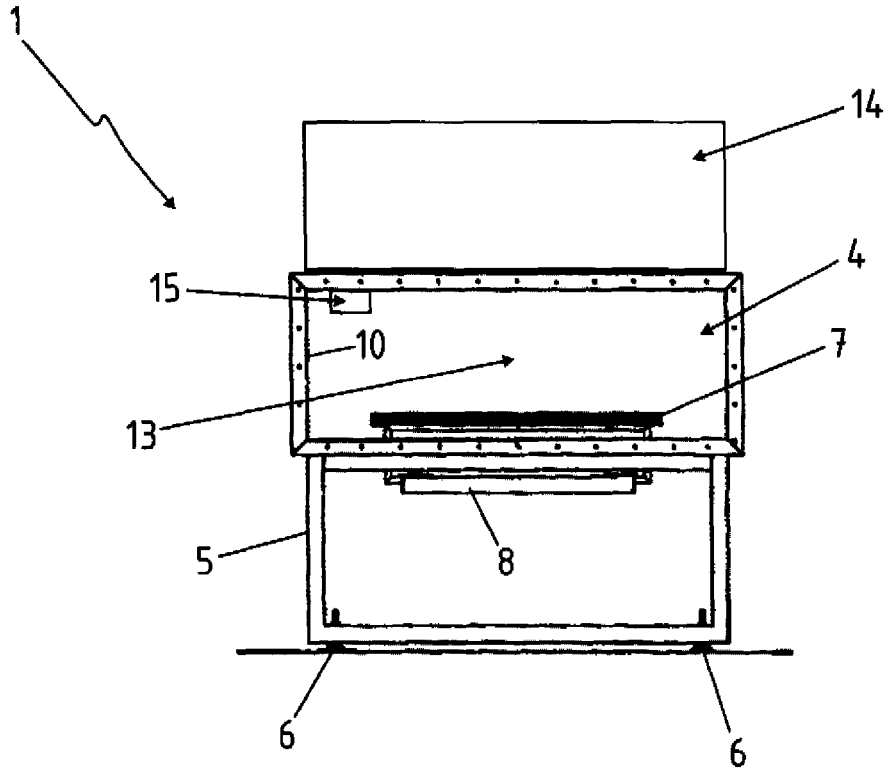
FIG. 5 is a schematic illustration of the apparatus of FIG. 1 with depiction of a lid and temperature sensor.

As shown by way of example in FIG. 5, a temperature sensor 15 may be used to ascertain and monitor the heating profile of the structure 13.

After the structure 13 has been heated to a temperature of about 700° C. after about 28 seconds, the heating-up rate slows down and the structure 13 is heated to the desired temperature of about 900° C. after about 50 seconds and is austenitized.

As the desired temperature is reached, the temperature sensor 15 causes an opening of the access opening 3 of the furnace 1. The robot 11, equipped with the coupling unit 12, grabs the structure 13 and removes it from the placement area 7 and guides it through the access opening 3 out of the furnace chamber 4 for transfer, e.g., to a shaping facility, not shown in greater detail.

As soon as the robot 11 has transferred the structure 13 to the shaping facility, the robot 11 withdraws a next structure from a magazine (not shown) for transport to the empty furnace 1 to undergo a heating process, as described above. In the arrangement of FIG. 3, the neighboring furnace 1*a* can accommodate a structure 13*a* that has been heated already, as shown in FIG. 3, and can be removed after reaching the desired temperature by the robot 11 from the furnace chamber 4*a* via the access opening 3*a* for subsequent transfer to the shaping facility.

By the continuous exchange between loading and unloading of each individual furnace 1, 1*a*, heated structures 13, 13*a* can be continuously supplied to a hot forming facility (not shown).

FIG. 4 shows a graphical illustration of a measurement of the structure temperature as a function of the elapsed time in a continuous furnace. The diagram shows on a horizontal axis the time and on a vertical axis the measured temperature at three different measuring points of the structure 13. The time span necessary for the heating process of the structure 13 is about 180 seconds. Three qualitatively similar measuring curves MP1, MP2 and MP3 are illustrated at different regions of the structure 13, with the measuring points MP1 lying in a depression (hole) and MP2 in the middle of the structure 13.

An interior temperature of the continuous furnace is preset at about 1150° C. and thus is significantly above a desired temperature of the structure 13 of about 900° C. The temperature of the structure 13 is at an ambient temperature of about 25° C. when placed into the continuous furnace.

The measuring curves MP1, MP2 and MP3 indicate that the heating-up rate of the structure 13 in the furnace atmosphere of about 25° C. to about 700° C. extends almost linear and on average is about 24° C. per second and requires about 28 seconds. During the further course, the heating-up rate decreases continuously so that the structure 13 reaches its desired temperature of about 900° C. after 50 seconds. Only after further 70 seconds and thus after a total of about 120 seconds does the structure 13 reach the interior temperature of the furnace of about 1150° C.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A method of heating a structure for a hot forming process, said method comprising the steps of:

heating an interior space of a furnace to an interior temperature which is greater than a desired temperature to which a structure is intended to be heated;

placing the structure into the furnace while the interior space is at least at the interior temperature at all times;

removing the structure from the furnace when the structure has been heated to the desired temperature;

determining a temperature of the structure while being heated in the interior space; and opening the furnace, when the structure has reached the desired temperature.

2. The method of claim 1, wherein the interior temperature is at least 15% above the desired temperature.

3. The method of claim 1, wherein the interior temperature is 1100° C. to 1200° C. and the desired temperature is 850° C. to 950° C.

4. The method of claim 1, wherein the furnace is a chamber furnace having a furnace chamber constructed to individually heat each structure.

5. The method of claim 4, further comprising the step of establishing a protective gas atmosphere in the furnace chamber.

6. The method of claim 1, wherein the structure is fixed in place while being heated in the interior space.

7. The method of claim 1, wherein the furnace is opened in a time-controlled manner.

8. The method of claim 1, wherein the structure is a steel sheet heated to a temperature >Ac3.

9. Apparatus for heating a structure; comprising:

a furnace having an interior space for placement of a structure to be heated, said interior space being heatable to an interior temperature which is greater than a desired temperature to which the structure is to be heated, said interior space being bounded by inside walls and a lid for opening and closing access to the interior space, with the structure being placed into the interior space at a maximum distance of 30 centimeters to the inside walls; and a temperature sensor determining a temperature of the structure while being heated in the interior space of the furnace, wherein the lid of the furnace is opened, when the structure has reached the desired temperature.

* * * * *